United States Patent [19]

Rogers

[11] Patent Number: 4,683,729

[45] Date of Patent: Aug. 4, 1987

[54] ANTI-THEFT APPARATUS FOR A RIDING SADDLE

[76] Inventor: Kermett A. Rogers, 7220 Hooper Rd., Baton Rouge, La. 70811

[21] Appl. No.: 747,765

[22] Filed: Jun. 24, 1985

[51] Int. Cl.[4] ..... E05B 73/00

[52] U.S. Cl. ..... 70/58; 70/14; 70/229; 70/232

[58] Field of Search ..... 70/14–18, 70/58, 59, 229, 232; 119/109; 211/4, 5, 8; 248/119.4; 54/37, 44, 46

[56] References Cited

U.S. PATENT DOCUMENTS

| | | | |
|---|---|---|---|
| 274,788 | 3/1883 | King | 70/58 |
| 486,256 | 11/1892 | Leehey et al. | 70/15 |
| 527,418 | 10/1894 | Free et al. | 70/15 |
| 606,118 | 6/1898 | Bowman | 211/5 |
| 673,612 | 5/1901 | Appleby | 70/49 |
| 924,824 | 6/1909 | Peebler | 70/18 |
| 1,221,354 | 4/1917 | Mitchell | 73/232 |
| 1,872,857 | 8/1932 | Wesson et al. | 70/16 |
| 2,048,424 | 7/1936 | Caldwell | 70/232 |
| 2,510,294 | 6/1950 | Rivolier | 70/16 |
| 2,656,706 | 10/1953 | Lucas | 70/232 |
| 3,067,846 | 12/1962 | Luebkeman | 70/232 |
| 3,112,636 | 12/1963 | McIntyre | 70/232 |
| 3,269,159 | 8/1966 | Young | 70/232 |
| 3,590,608 | 7/1971 | Smyth | 70/15 |
| 3,664,163 | 5/1972 | Foote | 211/4 |
| 3,667,259 | 6/1972 | Reque et al. | 70/14 |
| 3,982,413 | 9/1976 | Stone et al. | 70/14 |
| 4,126,024 | 11/1978 | Timmons et al. | 70/49 |
| 4,167,862 | 9/1979 | Gould | 70/18 |
| 4,398,500 | 8/1983 | Koronkiewicz | 119/109 |

FOREIGN PATENT DOCUMENTS

| | | | |
|---|---|---|---|
| 880789 | 6/1953 | Fed. Rep. of Germany | 70/49 |
| 436571 | 6/1948 | Italy | 70/16 |
| 615747 | 2/1980 | Switzerland | 70/18 |
| 2049587 | 12/1980 | United Kingdom | 70/229 |

*Primary Examiner*—Robert L. Wolfe
*Assistant Examiner*—Suzanne L. Dino
*Attorney, Agent, or Firm*—Robert C. Tucker; William D. Kiesel

[57] ABSTRACT

An anti-theft lock for a riding saddle is provided comprising a lock ring which is lockable around a saddle horn. The diameter of the lock ring is greater than that of the neck of the saddle horn, but less than that of the cap of the saddle horn. The lock ring may be tethered to an anchor or other fixed object. Once the ring is closed around the saddle horn it may be locked with a padlock or other locking mechanism.

11 Claims, 4 Drawing Figures

ANTI-THEFT APPARATUS FOR A RIDING SADDLE

BACKGROUND OF THE INVENTION

1. Field of Invention

This invention relates in general to locking devices and more particularly to such devices adapted to prevent the theft of a riding saddle.

2. Description of the Prior Art

Riding saddles are inherently high priced with costs ranging easily to $1,000.00 per unit. Saddles are also relatively compact and easy to transport. These factors make saddles high theft items when coupled with the aspect that they can be readily resold or used by the thief. Saddles are frequently used in public places (i.e. horse shows, rodeos, parades, etc). Consequently, saddles are frequently exposed to conditions which make them susceptible to theft. Saddle owners naturally subject their saddles to theft because a saddle is just large enough that the owner will not always attempt to keep it nearby. If the saddle cannot be kept on the horse or conveniently locked inside a vehicle, it is left exposed in a pickup or trailer bed, over a bale of hay, or on the ground. When so exposed, they may be easily and quickly carried off or simply placed into a car trunk making felonious removal easy for the thief.

This problem has existed for years upon years with no solution other than placing the entire saddle in a secured area. The many sizes and styles of available saddles add to the problem. A device is needed which will deter or prevent saddle theft while not encumbering the saddle owner with burdensome security measures.

No disclosure were discovered in the prior art which addressed the above described problem. There have been applications of locking mechanisms to deter theft of airplanes, skis, bicycles, and umbrellas as well as other locking mechanisms, disclosed in the following patents:

| U.S. PAT. NO. | INVENTOR | ISSUED | TITLE |
|---|---|---|---|
| 4,167,862 | T. Gould | 9/18/79 | ANTI-THEFT DEVICE FOR AIRCRAFT |
| 3,590,608 | C. Smyth & H. Smyth | 7/06/71 | LOCKING DEVICE |
| 527,418 | C. Free & N. Heath | 10/16/1894 | BICYCLE-LOCK |
| 662,334 | E. Appleby | 11/20/1900 | UMBRELLA LOCK |
| 1,823,697 | C. Nenstiehl | 9/15/31 | HANDCUFFS |
| 2,510,294 | A. Rivolier | 6/06/50 | MANACLES |
| 1,872,857 | H. Wesson & E. Pomeroy | 8/23/32 | POLICE OFFICER'S SHACKLE |
| 274,788 | J. King | 3/27/1883 | MAT-LOCK |

SUMMARY OF THE INVENTION

It is therefore an object of this invention to provide a simple, inexpensive, and lightweight anti-theft apparatus for a riding saddle. It is also an object of this invention to provide such an apparatus which may be applied to all types, models, and sizes of saddles. It is further an object of this invention to design an anti-theft apparatus which cannot be easily removed by a thief. It is still another object of this invention to deter theft by providing an anti-theft locking mechanism that, when forcibly removed, would detract from the value of the saddle. It is still a further object of this invention to make the apparatus of a hardened material which would resist cutting. Other objects and advantages of this invention shall become apparent from the ensuing description of this invention.

Accordingly, an anti-theft apparatus for a riding saddle is provided comprising a lock ring which is lockable around a saddle horn. The diameter of the lock ring is greater than that of the neck of the saddle horn, but less than that of the cap of the saddle horn. The lock ring may be tethered to an anchor or other fixed object. Once the ring is closed around the saddle horn, it may be locked with a padlock or a similar locking mechanism.

DETAILED DESCRIPTION

Figure 1:
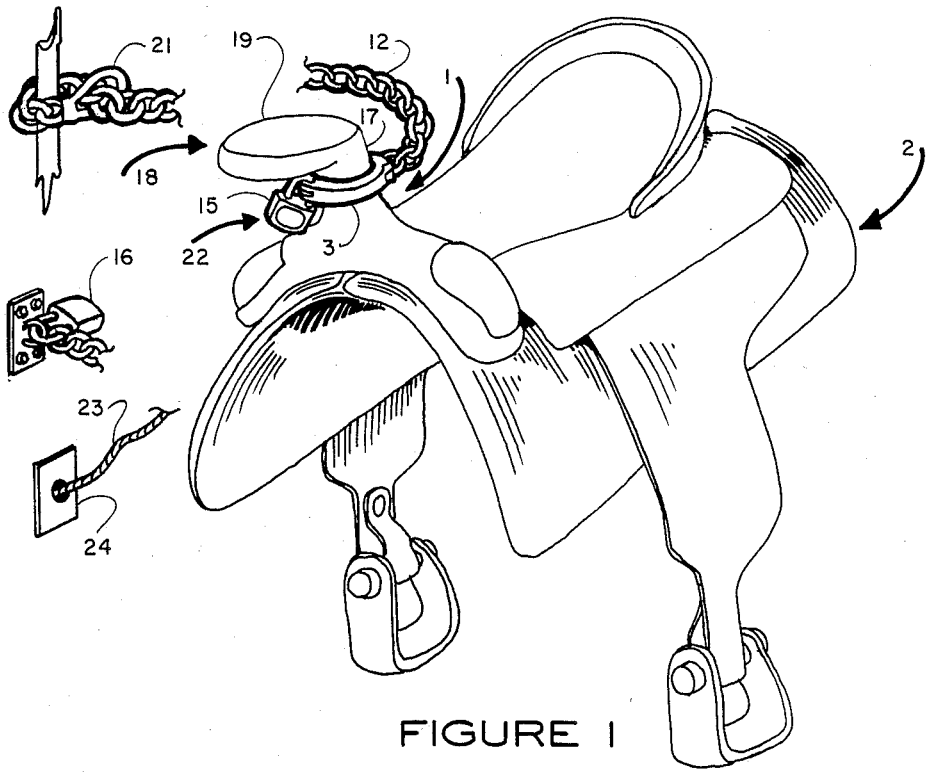
FIG. 1 is a three-dimensional view showing the use of one embodiment of the anti-theft apparatus around a saddle horn.
Figure 2:
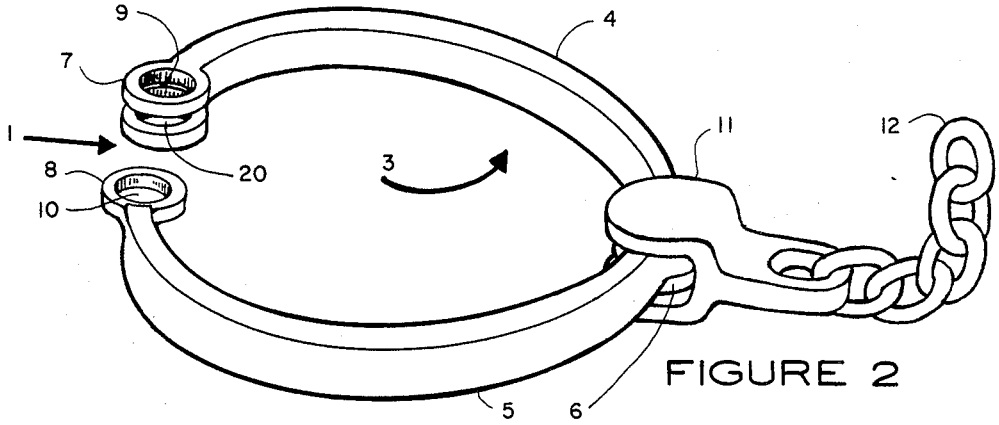
FIG. 2 is a detailed perspective view showing a preferred embodiment of the anti-theft apparatus removed from the saddle horn.

Referring now to the drawings, and more particularly to FIG. 1, a saddle locking apparatus 1 is illustrated in closed position on a saddle horn 18. Referring to FIGS. 1 and 2, the saddle locking apparatus 1 comprises a lock ring 3 which is lockable around the neck 17 of saddle horn 18. The ring 3 must have a diameter greater than that of neck 17, but smaller than that of cap 19, such that the apparatus 1 may not be removed over the horn 18. By locking lock ring 3 around the neck 17 of the saddle horn 18, problems with variations in saddle style are greatly reduced, since saddle horns 18 are generally made according to only a few standard sizes. In a preferred embodiment, lock ring 3 is divided into segments 4 and 5 which are operatively connected to hinge 6. Segments 4 and 5 are arcuate in shape and are of a configuration such that their respective ends 7 and 8 clasp together and have apertures 9, 10 and 20 which, when aligned, allow for insertion of a padlock locking bar 15. Still more preferably, hinge 6 is enclosed by a connector 11 attachable to a tether 12. Tether 12 is preferably a cable or case-hardened chain. The opposite end of the tether 12 is connected to an anchor such as an enclosing loop 21 or second locking mechanism 16. Other embodiments of tether 12 are possible, such as a retractable cable 23 with its retraction mechanism located within an enclosure 24, such as a horse trailer or truck to prevent tampering.

Figure 3:
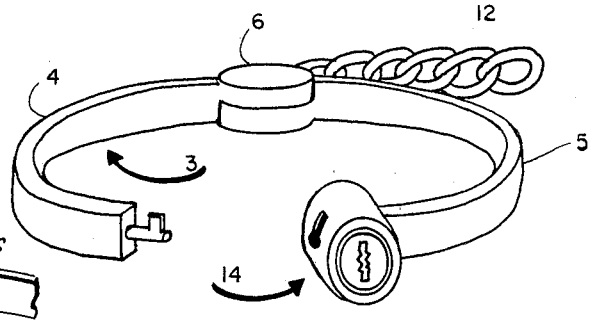
FIG. 3 shows an alternate embodiment of the invention whereby a locking mechanism is fixedly connected to the lock ring.
Figure 4:
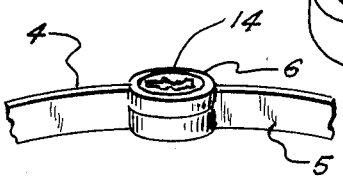
FIG. 4 shows an alternate embodiment of the invention whereby a locking mechanism is incorporated into the hinge of the lock ring.

A second preferred embodiment is shown in FIG. 3 whereby the need for a padlock or similar external locking mechanism is alleviated by integral locking mechanism 14, fixedly connected to lock ring 3. Another embodiment (not shown) would entail placing the locking mechanism in a protective casing so that a bolt cutter or similar device would not be effective in opening the lock. Locking mechanism 14 also could be integrally incorporated into hinge 6 and/or connector 11. Lock ring 3 could take various forms so long as it is lockable around saddle horn neck 17 and has a diameter less than that of saddle horn cap 19.

It is preferred that lock ring 3 be of a precise configuration so as to just fit around the neck 17 of saddle horn 18. Such a configuration will provide additional protection, since a tight fitting lock ring 3 will be difficult to tamper with. For example, it would be difficult to apply bolt cutters or saw the lock ring 3 without damaging the saddle 2. Also, even if the thief were to successfully detach the tether 12, commonly used cutting means, such as cutting torches, would severely damage the saddle 2. The prospect of so damaging the stolen merchandise will even further deter theft. A further deterrant may be provided by selecting a padlock 22 having a locking bar 15 with a curvature such that it will just fit through apertures 8, 9, and 20, as shown in FIG. 1, thus making it difficult to maneuver lock 22 into a position to facilitate tampering.

Many other variations, modifications, and alternate embodiments may be made in the apparatus and techniques described herein by those having experience in this technology, without departing from the concept of the present invention. Accordingly, it should be clearly understood that the apparatus and methods depicted in the accompanying drawings and referred to in the foregoing description are illustrative only and are not intended as limitations on the scope and spirit of this invention as defined in the following claims.

I claim:

1. In combination with a riding saddle including a saddle horn having a neck, a means for preventing the theft of said saddle, comprising a lock ring, having an interior diameter just greater than that of said neck, said ring being lockable around said neck and connectable to a tether.

2. In combination with a riding saddle including a saddle horn having a neck, a means for preventing the theft of said saddle, comprising a lock ring, having a shape conforming to the neck of a saddle horn such that said lock ring will just fit around said neck when in a closed position, said lock ring including two ring segments, connected together by a hinge means, for allowing the opening and closing of said ring segments around said neck, said lock ring being lockable around said neck and having a connection for a tether to be connected thereto.

3. An anti-theft apparatus for riding saddles according to claim 2, further comprising a lock means, for locking said segments together around said saddle horn.

4. An anti-theft apparatus for riding saddles according to claim 2, further comprising a tether means, for connecting said lock ring to a fixed object, said tether means being connectable at one end to said lock ring and at the other end to said fixed object.

5. An anti-theft apparatus for riding saddles according to claim 3, wherein said lock means is fixedly connected to said lock ring.

6. An anti-theft apparatus for riding saddles according to claim 3, wherein said lock means comprises a padlock.

7. An anti-theft apparatus for riding saddles according to claim 2, wherein each said ring segment is provided with at least one aperture therethrough, said apertures being alignable when said ring segments are closed around said saddle horn, such that the locking bar of a padlock will pass through said apertures when they are so aligned.

8. An anti-theft apparatus for riding saddles according to claim 7, further comprising a padlock, lockable through said apertures when they are aligned.

9. An anti-theft apparatus for riding saddles according to claim 8, further comprising a tether means, for connecting said lock ring to a fixed object, said tether means being connectable at one end to said lock ring and at the other end to said fixed object.

10. An anti-theft apparatus for riding saddles according to claim 9, wherein said tether means comprises a retractable cable.

11. An anti-theft apparatus for riding saddles according to claim 3, wherein said lock means is incorporated into said hinge means.

* * * * *